US006318830B1

(12) United States Patent
Sugishima

(10) Patent No.: US 6,318,830 B1
(45) **Date of Patent: *Nov. 20, 2001**

(54) IMAGE PRINTING METHOD, AND APPARATUS THEREOF

(75) Inventor: Kiyohisa Sugishima, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/133,303

(22) Filed: Oct. 8, 1993

(30) Foreign Application Priority Data

Oct. 13, 1992 (JP) ..... 4-274122

(51) Int. Cl.[7] ..... B41J 29/38; B41J 2/205; B41J 29/393

(52) U.S. Cl. ..... 347/12; 347/13; 347/15; 347/19

(58) Field of Search ..... 347/12, 13, 15, 347/16, 41, 19, 2, 3, 104, 40, 9

(56) References Cited

U.S. PATENT DOCUMENTS

| | | | | |
|---|---|---|---|---|
| 4,313,124 | | 1/1982 | Hara | 347/57 |
| 4,345,262 | | 8/1982 | Shirato et al. | 347/10 |
| 4,400,101 | | 8/1983 | Hendrischk . | |
| 4,459,600 | | 7/1984 | Sato et al. | 347/47 |
| 4,463,359 | | 7/1984 | Ayata et al. | 347/56 |
| 4,521,123 | | 6/1985 | Boehmer . | |
| 4,521,805 | * | 6/1985 | Ayata | 347/13 X |
| 4,558,333 | | 12/1985 | Sugitani et al. | 347/65 |
| 4,608,577 | | 8/1986 | Hori | 347/66 |
| 4,617,580 | * | 10/1986 | Miyakawa | 347/16 |
| 4,723,129 | | 2/1988 | Endo et al. | 347/56 |
| 4,740,796 | | 4/1988 | Endo et al. | 347/56 |
| 4,748,453 | * | 5/1988 | Lin et al. | 347/41 |
| 4,855,752 | * | 8/1989 | Bergstedt | 347/41 |
| 4,864,328 | * | 9/1989 | Fischbeck | 347/40 |
| 4,935,821 | * | 6/1990 | Sano et al. | 358/427 |
| 4,967,203 | | 10/1990 | Doan et al. | 347/41 |
| 4,999,646 | | 3/1991 | Trask | 347/41 |
| 5,101,283 | * | 3/1992 | Seki et al. | 358/456 |
| 5,146,236 | * | 9/1992 | Hirata et al. | 347/12 |
| 5,237,344 | * | 8/1993 | Tasaki | 347/9 |
| 5,327,166 | * | 7/1994 | Shimada | 347/15 X |
| 5,359,355 | * | 10/1994 | Nagoshi | 347/9 |
| 5,477,246 | | 12/1995 | Hirabayashi et al. | 347/12 |
| 5,661,508 | * | 8/1997 | Sugimoto | 347/9 |

FOREIGN PATENT DOCUMENTS

| | | | | |
|---|---|---|---|---|
| 2070355 | * | 12/1992 | (CA) | 347/12 |
| 0173952 | | 3/1986 | (EP) . | |
| 0430064 | | 6/1991 | (EP) . | |

(List continued on next page.)

OTHER PUBLICATIONS

IBM Technical Disclosure Bulletin, "All–Points–Addressable Printing Improvement", vol. 28, No. 8, pp. 3255–3256, Jan. 1986.

*Primary Examiner*—John Barlow
*Assistant Examiner*—An H. Do
(74) *Attorney, Agent, or Firm*—Fitzpatrick, Cella, Harper & Scinto

(57) ABSTRACT

Provided are an image printing method and apparatus in which printing is made possible in a multiscanning mode for printing the same line using a plurality of printing elements of a printing head in order that uneven density caused by a variance in the printing elements may be rendered inconspicuous. When the multiscanning mode is designated, a plurality of nozzles of the printing head are divided into a plurality of blocks, the nozzle blocks used are changed over every scan of the printing head, and the image of the printing width (band) printed using all of the nozzles is printed by causing the printing head to perform scanning a plurality of times.

62 Claims, 6 Drawing Sheets

FOREIGN PATENT DOCUMENTS

| | | | |
|---|---|---|---|
| 0526233 | 2/1993 | (EP) . | |
| 54 056847 | 5/1979 | (JP) . | |
| 59 123670 | 7/1984 | (JP) . | |
| 59 138461 | 8/1984 | (JP) . | |
| 60 071260 | 4/1985 | (JP) . | |
| 2088264 | 3/1990 | (JP) . | |
| 3-142252 | 6/1991 | (JP) | 347/12 |
| 4-259566 | 9/1992 | (JP) | 347/12 |
| 60-120072 | 6/1985 | (JP) | 347/14 |
| 4-244855 | 9/1992 | (JP) | 347/15 |

* cited by examiner

IMAGE PRINTING METHOD, AND APPARATUS THEREOF

BACKGROUND OF THE INVENTION

1. Field of the Invention

This invention relates to an image printing method and apparatus, as well as to a copying apparatus, in which an image is printed on the basis of entered image information by scanning a printing head having a plurality of printing elements (nozzles or heating elements) arranged in a direction substantially perpendicular to the scanning direction of the printing head.

2. Description of the Related Art

In an ink-jet printer known in the art, an ink-jet head having a plurality of nozzles arranged in a subscan direction is mounted on a carriage and the carriage is made to scan in a main-scan direction to perform printing. When printing is performed using an ink-jet head, images on a plurality of lines are capable of being printed simultaneously on a recording medium such as recording paper by a single scan of the carriage. The width of the image thus printed generally is referred to as a "band".

With an ink-jet head of this kind, however, 128 nozzles, for example, are arranged at intervals of about 60 $\mu$m, and inevitably a variance develops in the accuracy with which ink is jetted from each of the nozzles. This variance in the jetting accuracy appears as unevenness in the printing density of the printed image. Such uneven density gives rise to a decline in the image quality of the printed image.

SUMMARY OF THE INVENTION

An object of the present invention is to provide an image printing method and apparatus; as well as a copying apparatus, in which the printing speed is improved and printing can be performed without a conspicuous unevenness in density caused by such a printing head.

Another object of the present invention is to provide an image printing method and apparatus, as well as a copying apparatus, in which an image is printed upon selecting between a method of printing the same line using a plurality of printing elements and a method of printing the same line using a specific printing element, thereby making it possible to perform printing without conspicuous unevenness in the density of the printed image.

A further object of the present invention is to provide an image printing method and apparatus, as well as a copying apparatus, in which an image can be printed by changing over between methods, i.e., by printing the same line using a specific printing element in a case where an image having inconspicuous density unevenness is printed, and printing the same line using a plurality of printing elements in a case where an image having conspicuous density unevenness is printed.

Still another object of the present invention is to provide an image printing method and apparatus, as well as a copying apparatus, in which a plurality of nozzles of the ink-jet head are divided into a plurality of blocks, print data corresponding to one band is divided in conformity with each of the plurality of nozzle blocks, and one band is printed by causing the printing head to scan a plurality of times.

Yet another object of the present invention is to provide an image printing method and apparatus, as well as a copying apparatus, in which an image whose image data has a high density and whose density unevenness is inconspicuous is printed by the usual single scan, whereas an image having a low density and a conspicuous density unevenness is printed by multiple scans.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

Preferred embodiments of the present invention will now be described in detail with reference to the accompanying drawings.

Figure 1:
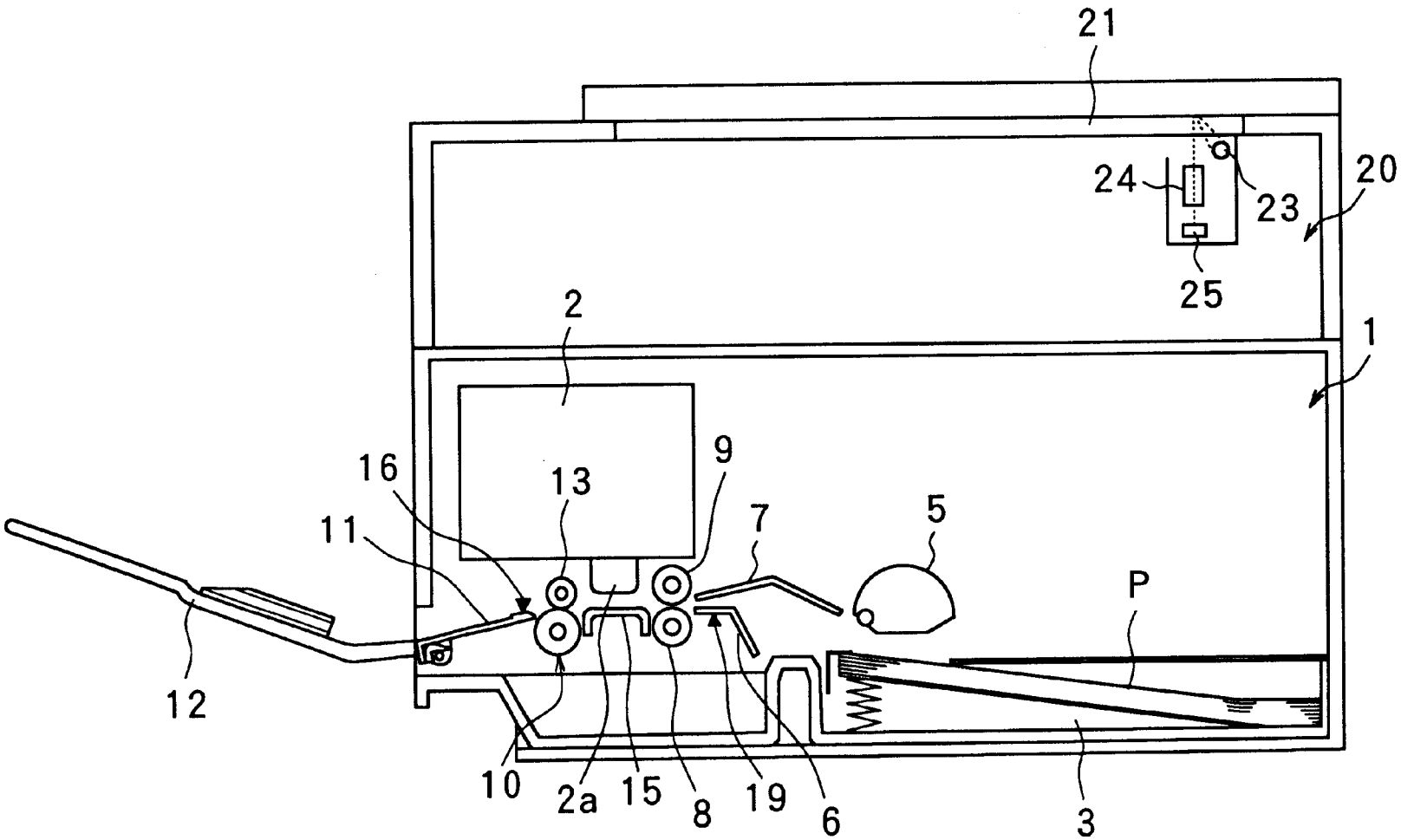
FIG. 1 is a structural sectional view illustrating the internal structure of a copying apparatus embodying the present invention.

FIG. 1 is a structural sectional view illustrating the internal structure of a full-color copying apparatus using an ink-jet printer according to an embodiment of the present invention.

The full-color copying apparatus of this embodiment comprises a reader 20 (hereinafter referred to as a scanner) for reading an original, and a printing unit I for printing the image of the original on a recording medium such as recording paper. In the scanner 20, the original placed upon a glass platen 21 is illuminated by an illuminating lamp 23, and light reflected from the original is imaged upon an photoelectric transducer (a reading sensor) 25 via a lens 24. The photoelectric transducer 25 generates an electric signal based upon the image of the original incident thereon, and information indicative of the original image can be obtained based upon this electric signal. The photoelectric transducer 25 is caused to scan below the original from right to left in the drawing (the main-scan direction) owing to rotation of a main-scan motor 416 (see FIG. 6) and is moved in the sub-scan direction owing to rotation of a sub-scan motor 417, whereby the image of the original is scanned in successive fashion.

Furthermore, the photoelectric transducer 25 is composed of a row of microelements to respective ones of which R, G and B filters are attached. Thus, an image signal representing one pixel is generated by three elements. The density of these elements is 400 elements per inch, and the total number of elements is that for 144 pixels (144×3=432). After making one round trip in the left-right direction as seen in the drawing, the photoelectric transducer 25 is moved by the width of one read (printed) pixel inward in FIG. 1 so that the next line of the original image is read. An image signal for the entire original is obtained by repeating this operation a number of times conforming to the size of the original. The image signal obtained by the photoelectric transducer 25 is subjected to image processing such as a color correction, a luminancedensity conversion and then a density correction, after which the signal is sent to the printing (recording) head of the printing unit 1 as a four-value signal for each of the colors cyan (C), magenta (M), yellow (Y) and black (K), which are the colors of the inks used in the printer.

In the printing unit 1, recording paper P is fed from a paper cassette 3 by a paper-feed roller 5 and reaches conveyor rollers 8, 9 through a paper-feed sensor 19 and paper-feed guides 6, 7. The recording paper conveyed by the conveyor rollers 8, 9 reaches the platen 15. On the basis of the image information from the scanning unit 20, ink within an ink tank 2 is discharged (jetted).from nozzles onto the recording paper, which has been conveyed to the platen 15, by means of the printing head 2*a*, whereby an image conforming to the image of the original is printed. The printing head 2*a* has a row of 128 nozzles arranged in a direction (sub-scan direction) substantially perpendicular to the scanning direction of the printing head 2*a* and is capable of printing an image by a single scan of the printing head 2*a*. That is, the printing head 2*a* performs printing, while being made to scan inward in FIG. 1, in synchronism with the reading operation of the photoelectric transducer 25 of the scanning unit 1. One band (a width of about 8 mm) of an image thus is printed on the recording paper.

When the printing of one band of the image ends, the recording paper is conveyed by an amount equivalent to one band by conveyor rollers 8, 9, 10, 13 in order to prepare for printing of the next band. When the printing of one page of the original ends, the recording paper on which printing has been completed is discharged into a paper-discharge tray 12 through a conveyance path 11. Numeral 16 denotes a paper-discharge sensor for sensing whether or not the recording paper is in the conveyance path 11.

Figure 2:
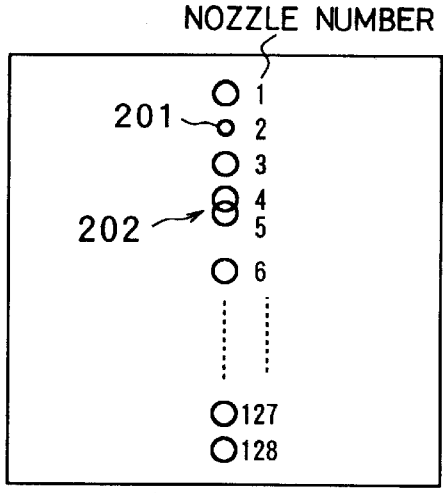
FIG. 2 is a schematic view illustrating the manner in which ink is jetted by an ink-jet head.
Figure 3:
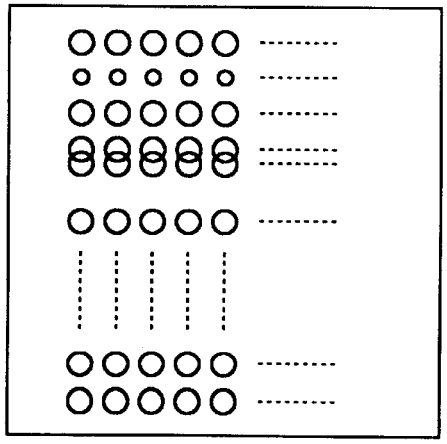
FIG. 3 is a diagram showing an example in which an image is printed using an ink-jet head having the characteristic illustrated in FIG. 2.
Figure 4:
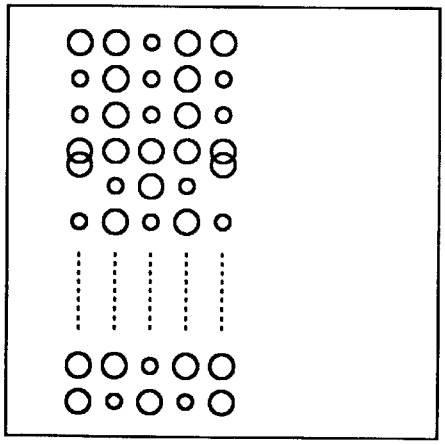
FIG. 4 is a diagram showing an example in which an image is printed by sequential multiscanning using an ink-jet head having the characteristic illustrated in FIG. 2.

FIGS. 2 through 4 are diagrams for describing uneven printing in an ink-jet head (multinozzle head) having a plurality of nozzles.

FIG. 2 is a diagram illustrating the manner in which ink is discharged by such an ink-jet head. As shown in FIG. 2, the output of the multinozzle head develops a variance in the size of the discharged ink droplets, as shown at 201 in FIG. 2, owing to the manufacturing precision of the ink-jet head, the quality of the material or a change in the ink with the passage of time. Another problem is that since the ink is not discharged at right angles to the head surface, dots may overlap each other, as indicated at 202 in FIG. 2.

When one band is printed using an ink-jet head of this kind, locations develop at which the ink droplets are too small and at which the dots are spaced too far apart because the ink is not discharged at right angles to the head. These locations produce strips (banding) that are too faint or strips (banding) where the ink droplets are too large. In addition, portions at-which ink dots overlap produce image strips that are too dark. These strip-like portions (banding) appear as an unevenness in the density of the image. (In this embodiment, this conventional method of scanning is referred to as single scanning.)

Accordingly, if, when one band is to be printed, the print head 2*a* is scanned.a plurality of times and the nozzle used is changed each time one pixel is printed, portions where the ink is too dark or too light are dispersed, as shown in FIG. 4, as a result of which the aforementioned uneven density is rendered inconspicuous. In this embodiment, this novel method of printing shall be referred to as "sequential multiscanning".

The unevenness in the density is conspicuously shown in the half-tone print mode in which an ink dot is alternately discharged, but the unevenness becomes less noticeable in a case where a dense image is printed because of spreading ink on a paper.

Figure 5:
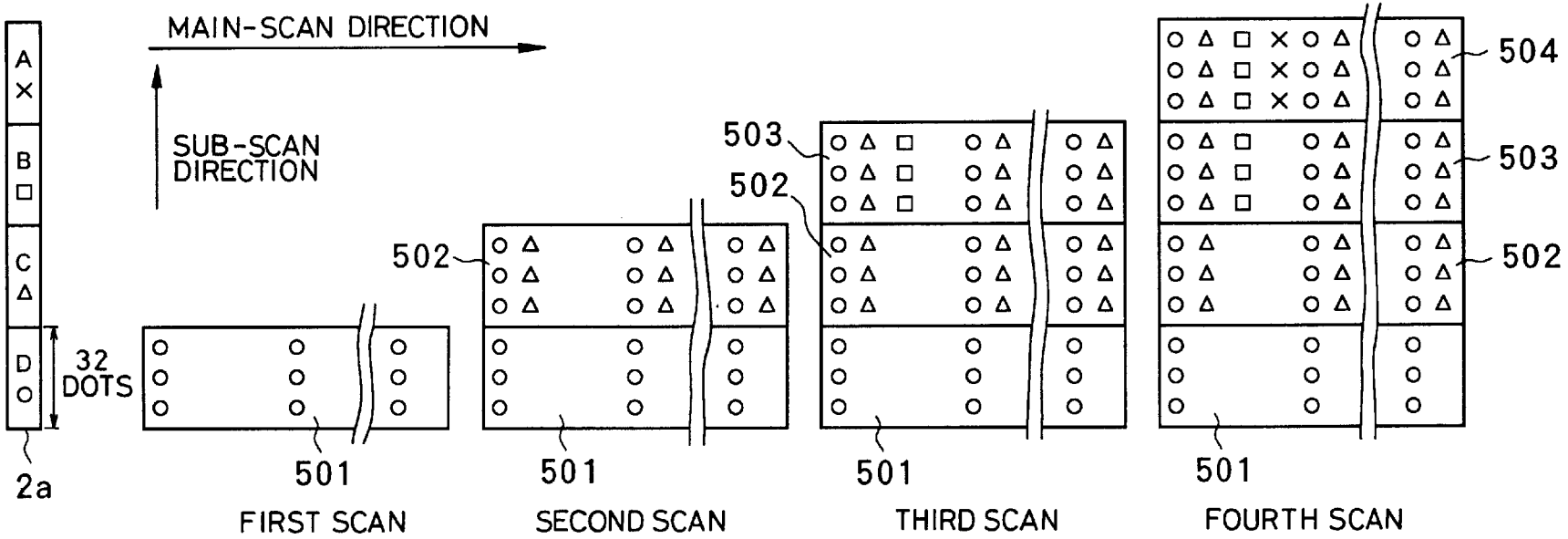
FIG. 5 is a schematic view showing a process through which printing is performed by sequential multiscanning in a copying apparatus of the present invention.

FIG. 5 is a diagram schematically illustrating sequential multiscanning according to this embodiment.

Here the plurality of nozzles of the printing head 2*a* are divided into four blocks A through D. As shown in FIG. 5, a dot printed by a nozzle in the block A of nozzles is represented by "X", a dot printed by a nozzle in the block B of nozzles is represented by "□", a dot printed by a nozzle in the block C of nozzles is represented by "Δ", and a dot printed by a nozzle in the block D of nozzles is represented by "○". First, printing is performed every four pixels in the main-scan direction using the nozzles of block D in the first scan. Printing by this first scan is indicated at 501 in FIG. 5.

Next, the recording paper is conveyed 32 pixels in the sub-scan direction (since the printing head 2*a* in this embodiment prints 128 pixels, the recording paper is conveyed by one-fourth of the total number of pixels, namely 32 pixels) and the nozzles of block C are used in the second scan to print dots every four pixels in the main-scan direction at locations offset by one pixel in the main-scan direction with respect to the dots printed by the nozzles of block D (the image thus printed is indicated at 502 in FIG. 5). Next, in the third scan, printing is performed in the same manner as in the second scan using the nozzles of block B (see 503 in FIG. 5). In the fourth scan, printing is performed in the same manner using the nozzles of block A (see 504). This ends the printing of one band by four scans of the printing head 2*a*.

Figure 6:
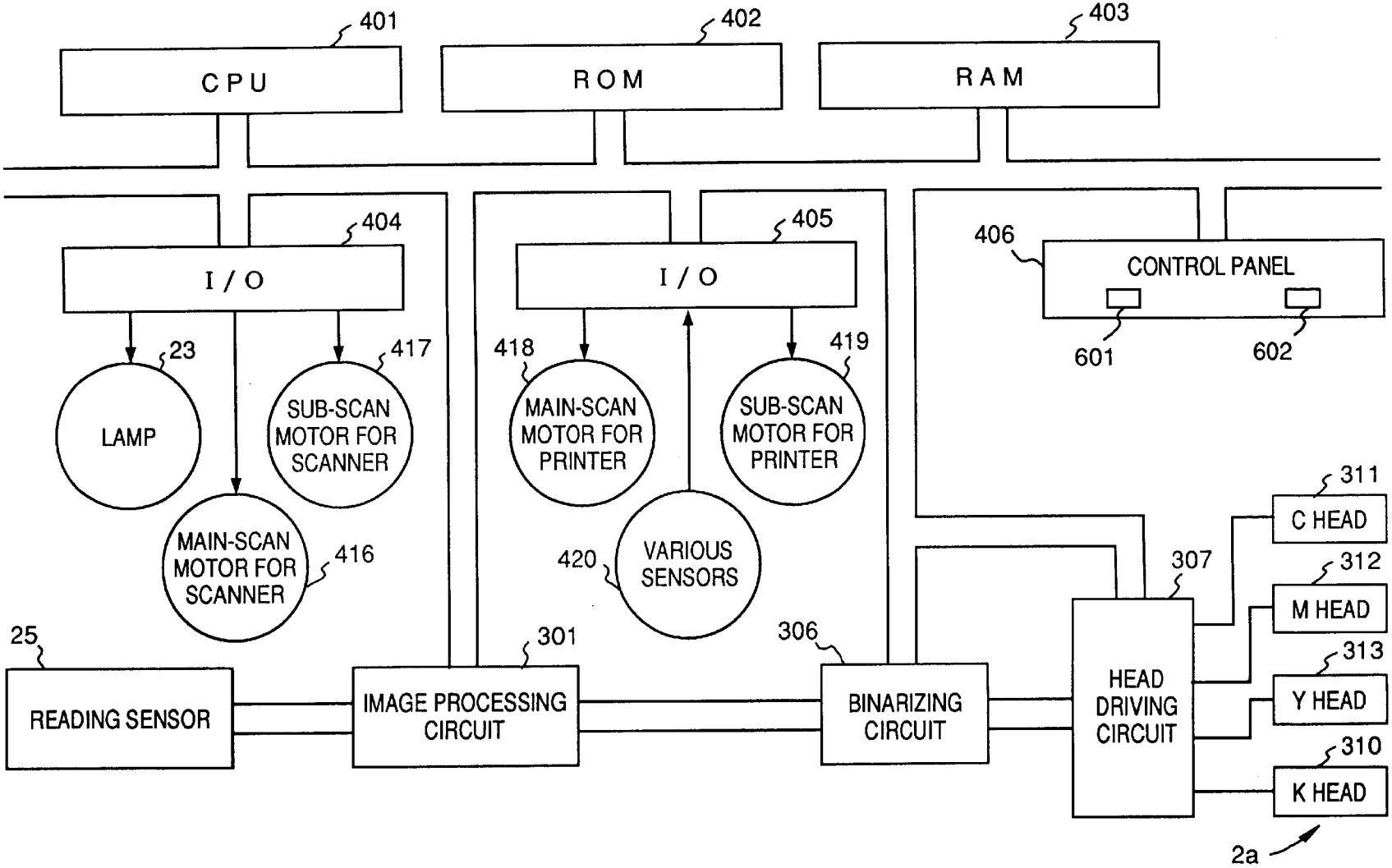
FIG. 6 is a block diagram schematically showing the construction of a full-color copying apparatus in this embodiment.

FIG. 6 is a block diagram schematically showing the construction of a full-color copying apparatus in this embodiment.

Figure 7:
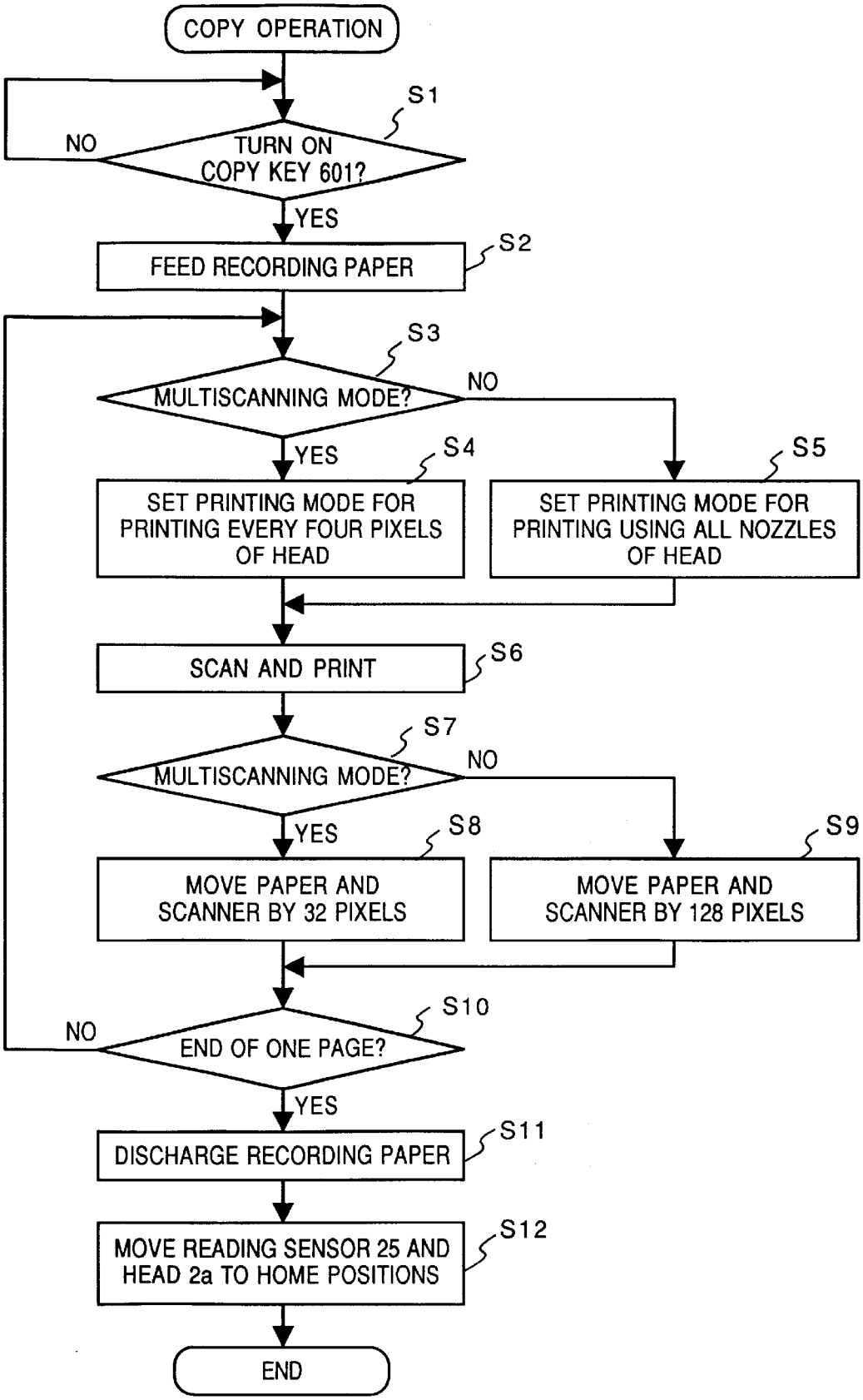
FIG. 7 is a flowchart illustrating copy processing in a copying apparatus according to a first embodiment of this invention.

A CPU 401 executes various control operations based upon a control program stored in a ROM 402 and illustrated in the flowchart of FIG. 7. A RAM 403 stores various working data that accompanies the operation of the CPU 401. A control panel 406 has a copy starting key 601 for commanding the start of copying, various keys for setting a variety of functions, such as a selection key (referred to as a "high-quality mode key") 602 for deciding whether printing is to be performed by sequential scanning, and a display for presenting a variety of messages to be viewed by the operator.

Input/output circuits I/O 404, I/O 405 control respective drive'sections. The illumination lamp 23 of the scanning unit 20 and the main-scan and sub-scan motors 416, 417 for moving the reading sensor 25 are connected to the I/O port 404. These input/output circuits are controlled by the CPU 401. A main-scan motor 418 for moving the printing head 2*a* of the printing unit 20, a sub-scan motor 419 for moving the recording paper, and various sensors 420 such as the paper-discharge sensor 16 and a paper-feed sensor 19 are connected to the I/O port 405. Motor-drive signals from the CPU 401 are outputted to the corresponding motors, and signals from the various sensors are outputted to the bus of the CPU 401.

The bus is further connected to an image processing circuit 301, which executes various processing such as a density-luminance conversion and undercolor removal, as well as to a binarizing circuit 306 for converting a multi-valued image signal into a binary image signal. The circuits also operate under the control of the CPU 401. The reading sensor 25 outputs RGB signals each composed of eight bits. This image signal is applied to the image processing circuit 301, which subjects the signal to a logarithmic conversion, namely the luminance-density conversion, masking processing for a color correction, black generation for producing a distinct black color and processing for zooming, etc. As a result of these processing operations, the signals are converted into eight-bit CMYK signals for the colors C (cyan), M (magenta), Y (yellow) and K (black), respectively. The CMYK signals are converted into binary data by the binarizing circuit 306, after which the resulting signals are outputted to respective ones of ink-jet heads 310~313 corresponding to these four colors via a head driving circuit 307. Each ink-jet head discharges ink conforming to the image signal, thereby performing printing. It should be noted that the head driving circuit 307 is capable of being set by the CPU 401 so that all nozzles of the ink-jet head are used to discharge ink for all of the pixels, so that dots are printed every several pixels or so that no ink is discharged at all.

FIG. 7 is a flowchart illustrating a copying operation in a copying apparatus according to this embodiment. The control program for executing this processing is stored in the ROM 402.

First, at step S1, it is determined whether the copy starting key 601 on the control panel 406 has been pressed to command the starting of the copying operation. If the key 601 has been pressed, the program proceeds to step S2, at which the recording paper P is fed into the apparatus from the paper cassette 3. Thus, when the sensor 19 senses that the recording paper has reached the position of the platen 15 owing to rotation of the conveyor rollers 8, 9, the program proceeds to step S3. Here it is determined whether the sequential multiscanning mode has been set, namely whether the high-quality mode switch 602 has been pressed on the control panel 406. The pixel printing mode [printing every four pixels (sequential scanning) or printing all pixels] of the head driving circuit 307 is set depending upon the status of the high-quality mode key 602.

More specifically, when the sequential multiscanning mode has been set (when the high-quality mode key has been pressed), the program proceeds to step S4. Here the nozzles of each head of the ink-jet heads 310~313 are divided into four blocks,. as shown in FIG. 5, and the mode for printing every four pixels in the main-scan direction is set. If the sequential multiscanning mode is not set, the program proceeds to step S5, at which the ordinary printing mode is set, namely the mode in which all nozzles of each ink-jet head are driven simultaneously and one band is printed by a single scan.

Thus, the program proceeds to step S6, where the image of the original is read and printing of the image is performed in synchronism with the reading operation. Here, since image processing such as shading of the original-image signal is completed in the scanning unit 20 when recording paper has been fed to the printing unit 1, the reading of the image of the original and the printing processing by the ink-jet heads 310~313 are capable of being performed while synchronization is achieved between the scanning unit 20 and the printing unit 1. Thus, copy processing comprising the reading of one band of the original and printing processing can be carried out.

When copy processing for one band is thus concluded, the program proceeds to step S7. Here, in a manner similar to that of step S3, it is determined whether the sequential multiscanning mode is in effect or not, and the amount by which the recording paper is conveyed is controlled based upon the result of the determination. More specifically, when the sequential multiscanning mode is in effect, the program proceeds to step S8. Here the recording paper and the reading sensor 25 are each conveyed by 32 pixels in the sub-scan direction. When the sequential multiscanning mode is not in effect, the program proceeds to step S9. Here the recording paper and the reading sensor 25 are each moved by 128 pixels (the printing width of the ink-jet head 2*a*).

Next, the program proceeds to step S10, at which it is determined, based upon sensing of the trailing edge of the recording paper and the size of the reading area of the scanning unit 20, whether the copy processing for one page of the original has been concluded. If the copy processing for one page has not been concluded, the program returns to step S3, where reading of the original and the printing operation by the printing unit 1 are repeated until copying ends.

When the copying of one page ends at step S10, the program proceeds to step S11, at which the recording paper that has been printed on is discharged from the copying apparatus. Then, at step S12, the reading sensor 25 and the ink-jet head 2*a* (heads 310~313) are returned to their home positions and copy processing is terminated.

In accordance with this embodiment, as described above, the arrangement is such that it is possible to select the single scanning mode, in which all of the pixels on one line are printed using specific nozzles, and the sequential multiscanning mode, in which pixels on the same line are printed using a plurality of nozzles. As a result, a full-color image having conspicuous unevenness is printed in the sequential multiscanning mode whereas a dense image or an image such as a manuscript of characters is printed in the single scanning mode. This makes it possible to raise printing speed.

Figure 8:
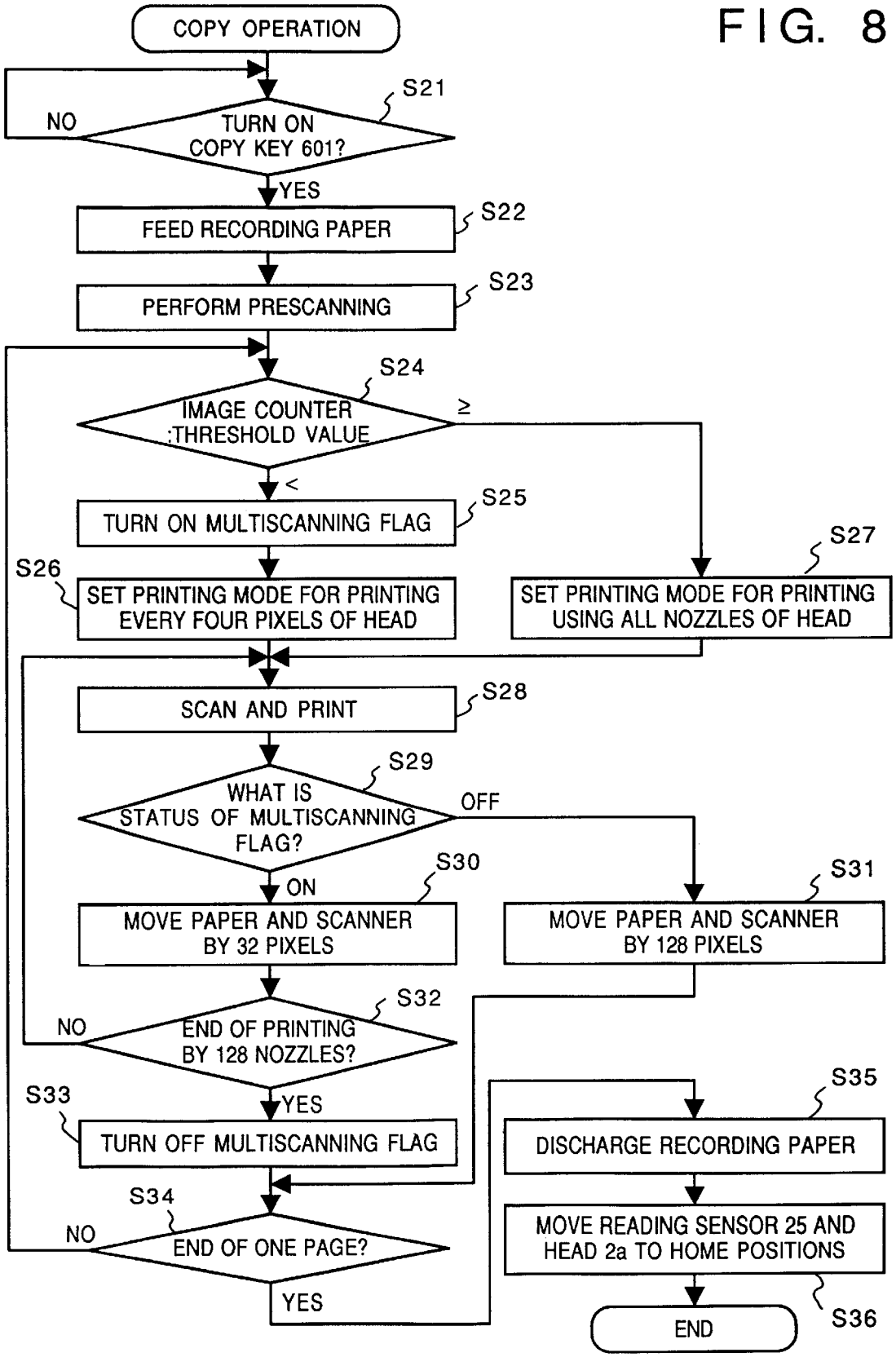
FIG. 8 is a flowchart illustrating copy processing in a copying apparatus according to another embodiment of this invention.

FIG. 8 is a flowchart illustrating copying processing in a full-color copying apparatus according to another embodiment of the invention. The control program for executing this processing is stored in the ROM 402. The construction of the copying apparatus according to this embodiment is similar to that shown in FIGS. 1 and 6 and need not be described again.

First, at step S21, it is determined whether the copy starting key 601 on the control panel 406 has been pressed to command the starting of the copying operation. If the key 601 has been pressed, the program proceeds to step S22, at which the recording paper P starts to be fed into the apparatus from the paper cassette 3. When the recording paper P has reached the position of the platen 15, the program proceeds to step S23, where one band of the image of the original is read by causing the reading sensor 25 to perform scanning. The program then proceeds to step S24, at which it is determined whether the density of the image to be printed is high or not. This is done by determining whether pixels for which the density is greater than 160 make up more than half the length of the band in the image data of any of the colors C, M, Y, K. In the case of a dense image, image unevenness caused by uneven discharging of the ink from the nozzles is not conspicuous. Accordingly, the head driving circuit 307 is set to the single scanning mode, in which printing of the image is performed by all of the nozzles of the ink-jet head.

On the other hand, if the image is faint, the program proceeds to step S25, at which a multiscanning flag (provided in the RAM 403) is turned on, and then to step S26, at which the head driving circuit 307 is set to the sequential multiscanning mode so that printing is performed every four pixels in the main-scan direction, as illustrated in FIG. 5. Specifically, in the case of an image having a low density, a decline in image quality due to uneven discharging of the ink from the nozzles is conspicuous. Therefore, in order to print an image of higher quality, the nozzles of each of the ink-jet heads 310~313 are divided into four blocks and the mode for printing every four pixels in the main-scan direction is set, as shown in FIG. 5.

Thus, the program proceeds to step S28, where the image of the original is read and printing of the image is performed in synchronism with the reading operation. Here, since image processing such as shading of the original-image signal is completed in the scanning unit 20 when recording paper has been fed to the printing unit 1, the reading of the image of the original and the printing processing by the ink-jet heads 310~313 are capable of being performed while synchronization is achieved between the scanning unit 20 and the printing unit 1. Thus, copy processing comprising the reading of one band of the original and printing processing can be carried out.

When copy processing for one band is thus concluded, the program proceeds to step S29. Here the status of the multiscanning flag is checked to determine whether the multiscanning mode is in effect, and the amount by which the recording paper is conveyed is controlled based upon the result of the determination. More specifically, when the sequential multiscanning mode is in effect, the program proceeds to step S30. Here the recording paper and the reading sensor 25 are each conveyed by 32 pixels in the sub-scan direction. Next, it is determined at step S32 whether the printing of 128 pixels and conveyance of the recording paper has ended, i.e., whether the copy processing of one band has been concluded. If the decision rendered is NO, then the program returns to step S28, where reading of the original conveyed by 32 pixels is performed and printing processing is executed. If it is determined at step S29 that the sequential multiscanning mode is not in effect, then the program proceeds to step S31, at which the recording paper and the reading sensor 25 are each moved by 128 pixels (the printing width of the ink-jet head 2*a*). The program then proceeds to step S34.

Thus, when printing by the 128 nozzles (one band) and the reading of the original end at step S32, the program proceeds to step S33, at which the multiscanning flag is turned off, and then to step S34, at which it is determined, based upon sensing of the trailing edge of the recording paper and the size of the reading area of the scanning unit 20, whether the copy processing for one page of the original has been concluded. If the copy processing for one page has not been concluded, the program returns to step S24, where reading of the original and the printing operation by the printing unit 1 are repeated until copying ends.

In this embodiment, scanning (which corresponds to the prescanning of step S23) for judging density from the second band onward is carried out at the time of back-scanning when the reading sensor returns to the starting position after reading the image.

When the copying of one page ends at step S34, the program proceeds to step S35, at which the recording paper that has been printed on is discharged from the copying apparatus. Then, at step S35, the reading sensor 25 and the ink-jet head 2*a* (heads 310~313) are returned to their home positions and copy processing is terminated.

In this embodiment, it is so arranged that a changeover is made between the single scanning mode in which one band is copied by a single scan and the sequential multiscanning mode in which one band is copied by sequential multiscanning, with the changeover being performed in dependence upon the image density of the original from one band to the next. However, an arrangement may be adopted in which the operator designates the mode area by area using an area designating function or the like.

Further, in this embodiment, the scanning method is changed over in conformity with the density of the image. However, an.arrangement may be adopted in which character information is judged and the printing mode is changed over based upon the results of judgment.

Furthermore, an arrangement may be adopted in which the entire original is prescanned by a low-resolution reading sensor and copying is carried out after the particular mode is decided.

Though the image density is judged at the time of back-scanning in the above-described embodiment, an arrangement may be adopted in which density is judged by performing prescanning at a speed higher than usual.

Though this embodiment has been described in connection with a copying apparatus, it goes without saying that the present invention is applicable also to a printing apparatus in which the printing mode is designated by a host or the like and the method of printing an image from the host is controlled in accordance with the designation, as well as to various other printing apparatus such as facsimile machine having a communication function.

Furthermore, though sequential multiscanning is employed as multiscanning in the above-described embodiment, the present invention is not limited to such an arrangement. An arrangement may be adopted in which a predetermined area (e.g. one band) is formed in complementary fashion by a plurality .of scans using different nozzle positions.

The present invention provides excellent effects especially in a printing apparatus having an ink jet printing head of the type in which printing is performed by forming flying droplets utilizing thermal energy.

With regard to a typical configuration and operating principle, it is preferred that the foregoing be achieved using the basic techniques disclosed in the specifications of U.S. Pat. Nos. 4,723,129 and 4,740,796. This scheme is applicable to both so-called on-demand-type and continuous-type apparatuses. In particular, in the case of the on-demand type, at least one drive signal, which provides a sudden temperature rise that exceeds that for film boiling, is applied, in accordance with print information, to an electrothermal transducer arranged to correspond to a sheet or fluid passageway holding a fluid (ink). As a result, thermal energy is produced in the electrothermal transducer to bring about film boiling on the thermal working surface of the printing head. Accordingly, air bubbles can be formed in the fluid (ink) in one-to-one correspondence with the drive signals. A discharging port is made to discharge the fluid (ink) by growth and contraction of the air bubbles so as to form at least one droplet. If the drive signal has the form of a pulse, growth and contraction of the air bubbles can be made to take place rapidly and in appropriate fashion. This is preferred since it will be possible to achieve fluid (ink) discharging having excellent response.

Signals described in the specifications of U.S. Pat. Nos. 4,463,359 and 4,345,262 are suitable as drive pulses having this pulse shape. It should be noted that even better printing can be performed by employing the conditions described in the specification of U.S. Pat. No. 4,313,124, which discloses an invention relating to the rate of increase in the temperature of the above-mentioned thermal working surface. In addition to the combination of the discharging port, fluid passageway and electrothermal transducer (in which the fluid passageway is linear or right-angled) disclosed as the construction of the recording head in each of the above-mentioned specifications, the present invention covers also an arrangement using the art described in the specifications of U.S. Pat. Nos. 4,558,333 and 4,459,600, which disclose elements disposed in an area in which the thermal working portion is curved.

Further, it is permissible to adopt an arrangement based upon Japanese Patent Application Laid-Open No. 59-123670, which discloses a configuration having a common slit for the discharging portions of a plurality of electrothermal transducers, or Japanese Patent Application Laid-Open No. 59-138461, which discloses a configuration having openings made to correspond to the discharging portions, wherein the openings absorb pressure waves of thermal energy.

It is permissible to use a freely exchangeable chip-type printing head attached to the main body of the apparatus and capable of being electrically connected to the main body of the apparatus and of supplying ink from the main body, or a cartridge-type recording head in which an ink tank is integrally provided on the printing head itself.

The addition of recovery means for the printing head and spare auxiliary means provided as components of the printing apparatus of the invention is desirable since these stabilize the effects of the invention greatly. Specific examples of these means that can be mentioned are capping means for capping the printing head, cleaning means, pressurizing or suction means, and preheating means such as an electrothermal transducer or another heating element or a combination thereof. Implementing a preliminary discharging mode for performing discharging separately of recording also is effective in order to perform stabilized printing.

The printing mode of the printing apparatus is not limited merely to a printing mode for a mainstream color only, such as the color black. The printing head can have a unitary construction or a plurality of printing heads can be combined. The apparatus can be one having at least one recording mode for a plurality of different colors or for full-color recording using mixed colors.

Further, ink is described as being the fluid in the embodiments of the invention set forth above. The ink used may be one which solidifies at room temperature or lower, or one which softens of liquefies at room temperature. Alternatively, in an ink-jet arrangement, generally the ink is temperature-controlled by regulating the temperature of the ink itself within a temperature range of between 30° C. and 70° C. so that the viscosity of the ink will reside in a region that allows stable discharging of the ink. Therefore, it is permissible to use an ink liquefied when the printing signal is applied.

In order to positively prevent elevated temperature due to thermal energy when this is used as the energy for converting the ink from the solid state to the liquid state, or in order to prevent evaporation of the ink, it is permissible to use an ink which solidifies when left standing. In any case, the present invention is applicable also in a case where use is made of an ink which solidifies in response to application of thermal energy, such as an ink solidified by application of thermal energy conforming to a printing signal or ink which has already begun to solidify at the moment it reaches the recording medium. Such inks may be used in a form in which they oppose the electrothermal transducer in a state in which they are held as a liquid or solid in the recesses or through-holes of a porous sheet, as described in Japanese Patent Application Laid-Open Nos. 54-56847 and 60-71260. In the present invention, the most effective method of dealing with these inks is the above-described method of film boiling.

Furthermore, as to the form of the printing apparatus according to the present invention, use is not limited to an image output terminal of an image processing apparatus such as a word processor or computer described above. Other configurations, which may be provided as a separate or integral part, include a copying machine in combination with a reader or the like, a facsimile machine having a transmitting/receiving function, etc.

In accordance with the other embodiment of the invention as described above, the density of one band of an image is judged and a changeover is made between the single scanning mode in which the entire image of one line is printed by a specific nozzle and the sequential multiscanning mode in which ink is discharged using a plurality of nozzles, whereby a full-color image in which unevenness is conspicuous even in one page of the original is printed in the sequential multiscanning mode. When a portion having high density, such as a character portion, is printed, unevenness in the density of the printed image is rendered inconspicuous, even when the image is printed in the single scanning mode. Printing speed is not slowed that much, the copying apparatus is easy to use and the copying apparatus employs a multinozzle head.

The present invention can be applied to a system constituted by a plurality of devices or to an apparatus comprising a single device. Furthermore, it goes without saying that the invention is applicable also to a case where the object of the invention is attained by supplying a program to a system or apparatus.

Thus, an effect obtained in accordance with the present invention, as described above, is that an image is printed upon selecting between a method of printing the same line using a plurality of printing elements and a method of printing the same line using a specific printing element, thereby making it possible to print an image without conspicuous unevenness in the density of the printed image.

Another advantage of the present invention is that an image can be printed by changing over between printing methods, i.e., by printing the same line using a specific printing element in a case where an image having inconspicuous density unevenness is printed, and printing the same line using a plurality of printing elements in a case where an image having conspicuous density unevenness is printed.

As many apparently widely different embodiments of the present invention can be made without departing from the spirit and scope thereof, it is to be understood that the invention is not limited to the specific embodiments thereof except as defined in the appended claims.

What is claimed is:

1. An image printing apparatus for causing a printing head having a plurality of printing elements to perform main scanning in a direction different from a direction in which the printing elements are arrayed and printing an image on a printing medium based upon entered image information, comprising:

first printing means for printing, by a single scan of said printing head, an image having a printing width within the image information that conforms to the plurality of printing elements;

second printing means for dividing said plurality of printing elements into a plurality of blocks, using the blocks of printing elements by changing over the blocks every scan, and printing the image having a width, which is substantially the same as the printing width printed by said first printing means, by causing said printing head to perform scanning a plurality of times and by performing a plurality of complementary printings using different blocks of the printing elements in each scanning;

selecting means for selecting said first printing means in a case that an optical density of the image information is higher than a predetermined value and for selecting said second printing means in a case that the optical density of the image information is lower than the predetermined value; and conveying means for conveying the printing medium by a length corresponding to the width of each block every scanning in a sub-scan direction substantially perpendicular to the direction of the main scanning.

2. The apparatus according to claim 1, wherein said second printing means prints an image by jumping several pixels at a time in a single scan, the number of pixels jumped conforming to the number of blocks.

3. The apparatus according to claim 1, wherein said printing head comprises an ink-jet head, and said plurality of printing elements comprise ink discharging nozzles.

4. The apparatus according to claim 3, wherein said printing head comprises a printing head that discharges ink by utilizing thermal energy and includes a thermal energy transducer for generating thermal energy applied to the ink.

5. The image printing apparatus according to claim 1, wherein said second printing means prints in the main scanning, using each of the plurality of blocks by changing over blocks in every main scanning, until every block has performed printing over the same printing area, and wherein neighboring dots printed in a direction of the main scanning by the plurality of blocks are printed using different printing elements of the printing head.

6. The image printing apparatus according to claim 5, wherein the dots printed in the direction of the main scanning are interlaced in modulus equal to the number of the plurality of blocks.

7. An image printing apparatus for causing a printing head having a plurality of printing elements to perform main scanning in a direction different from a direction in which the printing elements are arrayed and printing an image on a printing medium based upon entered image information, comprising:

first printing means for printing, by a single scan of said printing head, an image having a recording width within the entered image information that conforms to the plurality of printing elements;

second printing means for dividing said plurality of printing elements into a plurality of blocks, using the blocks of printing elements by changing over the blocks every scan, and printing the image, which is printed by said first printing means, by causing said printing head to perform scanning a plurality of times and by performing a plurality of complementary printings using different blocks of the printing elements in each scanning;

judging means for judging whether or not an optical density of the image information is higher than a predetermined value;

selecting means for selecting said first printing means in a case that the optical density of the image information is higher than the predetermined value and for selecting said second printing means in a case that the optical density of the image information is lower than the predetermined value; and conveying means for conveying the printing medium by a length corresponding to the width of each block every scanning in a sub-scan direction substantially perpendicular to the direction of the main scanning.

8. The apparatus according to claim 7, wherein said judging means judges optical the density of said image information based upon a number of pixels for which optical density contained in an image of a recording width conforming to said plurality of printing elements is greater than a predetermined value.

9. The apparatus according to claim 7, wherein said printing head comprises an ink-jet head, and said plurality of printing elements comprise ink discharging nozzles.

10. The apparatus according to claim 9, wherein said printing head comprises a printing head that discharges ink by utilizing thermal energy and includes a thermal energy transducer for generating thermal energy applied to the ink.

11. The image printing apparatus according to claim 7, wherein said second printing means prints in the main scanning, using each of the plurality of blocks by changing over blocks in every main scanning, until every block has performed printing over the same printing area, and wherein neighboring dots printed in a direction of the main scanning by the plurality of blocks are printed using different printing elements of the printing head.

12. The image printing apparatus according to claim 11, wherein the dots printed in the direction of the main scanning are interlaced in modulus equal to the number of the plurality of blocks.

13. An image printing method for causing a printing head having a plurality of printing elements to perform main scanning in a direction different from a direction in which the printing elements are arrayed and printing an image on a printing medium based upon entered image information, comprising:

a first printing step of printing, by a single scan of said printing head, an image having a printing width within the image information that conforms to the plurality of printing elements;

a second printing step of dividing said plurality of printing elements into a plurality of blocks, using the blocks of printing elements by changing over the blocks every scan, and printing the image having a width, which is substantially the same as the printing width printed in said first printing step, by causing said printing head to perform scanning a plurality of times and by performing a plurality of complementary printings using different blocks of the printing elements in each scanning;

a step of selecting said first printing step in a case that an optical density of the image information is higher than a predetermined value and for selecting said second printing step in a case that the optical density of the image information is lower than the predetermined value; and a step of conveying the printing medium by a length corresponding to the width of each block every scanning in a sub-scan direction substantially perpendicular to the direction of the main scanning.

14. The method according to claim 13, wherein said printing head comprises an ink-jet head, and said plurality of printing elements comprise ink discharging nozzles.

15. The method according to claim 14, wherein said printing head comprises a printing head that discharges ink by utilizing thermal energy and includes a thermal energy transducer for generating thermal energy applied to the ink.

16. The image printing method according to claim 13, wherein in said second printing step, printing is performed in the main scanning, using each of the plurality of blocks by changing blocks in every main scanning, until ovary block has performed printing over the same printing area, and wherein neighboring dots printed in a direction of the main scanning by the plurality of blocks are printed using different printing elements of the printing head.

17. The image printing method according to claim 16, wherein the dots printed in the direction of the main scanning are interlaced in modulus equal to the number of the plurality of blocks.

18. An image printing method for causing a printing head having a plurality of printing elements to perform main scanning in a direction different from a direction in which the printing elements are arrayed and printing an image on a printing medium based upon entered image information, comprising:

a judging step of judging whether or not an optical density of the image information is higher than a predetermined value;

a printing step of printing by a first mode or a second mode based upon the optical density judged, wherein said first mode prints, by a single scan of said printing head, an image having a recording width within the image information that conforms to the plurality of printing elements, and said second mode divides said plurality of printing elements into a plurality of blocks, uses the blocks of printing elements by changing over the blocks every scan, and prints the image having a width, which is substantially the same as the recording width printed in said first mode, by causing said printing head to perform scanning a plurality of times and by performing a plurality of complementary printings using different blocks of the printing elements in each scanning; and a conveying step of conveying the printing medium by a length corresponding to the width of each block every scanning in a sub-scan direction substantially perpendicular to the direction of the main scanning, wherein in said printing step, said second mode is selected in a case that the optical density of the image information is less than the predetermined value and said first mode is selected in a case that the optical density of the image information is higher than the predetermined value.

19. The method according to claim 18, wherein said printing head comprises an ink-jet head, and said plurality of printing elements comprise ink discharging nozzles.

20. The method according to claim 9, wherein said printing head comprises a printing head that discharges ink by utilizing thermal energy and includes a thermal energy transducer for generating thermal energy applied to the ink.

21. The image printing method according to claim 18, wherein in the second mode, printing is performed in the main scanning, using each of the plurality of blocks by changing blocks in every main scanning, until every block has performed printing over the same printing area, and wherein neighboring dots printed in a direction of the main scanning by the plurality of blocks are printed using different printing elements of the printing head.

22. The image printing method according to claim 21, wherein the dots printed in the direction of the main scanning are interlaced in modulus equal to the number of the plurality of blocks.

23. A copying apparatus for reading and copying an image of an original, comprising:

reading means for causing a photoelectric transducer to scan and read the original and outputting an electric signal corresponding to the image of the original;

print-data creating means for creating print data from the electric signal outputted by said reading means;

first printing means for printing, by a single scan of a printing head, an image having a printing width within said print data that conforms to a plurality of printing elements of said printing head;

second printing means for dividing said plurality of printing elements into a plurality of blocks, using the blocks of printing elements by changing over the blocks every scan, and printing the image width, which is printed by said first printing means, by causing said printing head to perform scanning a plurality of times and by performing a plurality of complementary printings using different blocks of the printing elements in each scanning;

selecting means for selecting said first printing means in a case that an optical density of the print data is higher than a predetermined value and for selecting said second printing means in a case that the optical density of the print data is lower than the predetermined value; and conveying means for conveying a printing medium by a length corresponding to the width of each block every scanning in a sub-scan direction substantially perpendicular to the direction of the main scanning.

24. The copying apparatus according to claim 23, wherein scanning of said photoelectric transducer of said reading means is performed in synchronism with scanning of said printing head by said first and second printing means.

25. The copying apparatus according to claim 23, wherein said printing head comprises an ink-jet head, and said plurality of printing elements comprise ink discharging nozzles.

26. The apparatus according to claim 23, wherein said printing head comprises a printing head that discharges ink by utilizing thermal energy and includes a thermal energy transducer for generating thermal energy applied to the ink.

27. The copying apparatus according to claim 23, wherein said second printing means prints in the main scanning, using each of the plurality of blocks by changing over blocks in every main scanning, until every block has performed printing over the same printing area, and wherein neighboring dots printed in a direction of the main scanning by the plurality of blocks are printed using different printing elements of the printing head.

28. The copying apparatus according to claim 27, wherein the dots printed in the direction of the main scanning are interlaced in modulus equal to the number of the plurality of blocks.

29. A copying apparatus for reading and copying an image of an original, comprising:

reading means for causing a photoelectric transducer to scan and read the original and outputting an electric signal corresponding to the image of the original;

print-data creating means for creating print data from the electric signal outputted by said reading means;

judging means for judging whether or not an optical density of the print data is higher than a predetermined value;

first printing means for printing, by a single scan of a printing head, an image having a printing width within said print data that conforms to a plurality of printing elements of said printing head;

second printing means for dividing said plurality of printing elements into a plurality of blocks, using the blocks of printing elements by changing over the blocks every scan, and printing the image having a width, which is substantially the same as the printing width printed by said first printing means, by causing said printing head to perform scanning a plurality of times and by performing a plurality of complementary printings using different blocks of the printing elements in each scanning;

control means for printing the image by selecting said first printing means in a case that the optical density of the print data is higher than the predetermined value and for selecting said second printing means in a case that the optical density of the print data is less than the predetermined value; and conveying means for conveying a printing medium by a length corresponding to the width of each block every scanning in a sub-scan direction substantially perpendicular to the direction of the main scanning.

30. The apparatus according to claim 29, wherein said printing head comprises an ink-jet head, and said plurality of printing elements comprise ink discharging nozzles.

31. The apparatus according to claim 29, wherein said printing head comprises a printing head that discharges ink by utilizing thermal energy and includes a thermal energy transducer for generating thermal energy applied to the ink.

32. The copying apparatus according to claim 29, wherein said second printing means prints in the main scanning, using each of the plurality of blocks by changing over blocks in every main scanning, until every block has performed printing over the same printing area, and wherein neighboring dots printed in a direction of the main scanning by the plurality of blocks are printed using different printing elements of the printing head.

33. The copying apparatus according to claim 32, wherein the dots printed in the direction of the main scanning are interlaced in modulus equal to the number of the plurality of blocks.

34. A copying apparatus for reading and copying an image of an original, comprising:

reading means for causing a photoelectric transducer to scan and read the original and outputting an electric signal corresponding to the image of the original;

print-data creating means for creating print data from the electric signal outputted by said reading means;

judging means for judging optical density of said print data;

first printing means for printing, by a single scan of a printing head, an image having a printing width within said print data that conforms to a plurality of printing elements of said printing head;

second printing means for dividing said plurality of printing elements into a plurality of blocks, using the blocks of printing elements by changing over the blocks every scan, and printing the image having a width, which is printed by said first printing means, by causing said printing head to perform scanning a plurality of times; and control means for printing the image by selecting said first printing means in a case that the optical density of the print data is higher than a predetermined value and selecting said second printing means in a case that the optical density of the print data is lower than the predetermined value.

35. An image recording apparatus for recording an image using a recording head having a plurality of recording elements, comprising:

image forming means for forming an image of a predetermined area by causing said recording head to perform main scanning in a direction different from a direction in which said recording elements are arrayed, said image forming means being operable in a single scanning mode for forming the image of said predetermined area in a single scan of said recording head, and a multiscanning mode for forming the image of said predetermined area in a plurality of complementary scans of different recording elements of said recording head;

selecting means for selecting said single scanning mode in a case that the image of the predetermined area has an optical density higher than a predetermined value and selecting said multiscanning mode in a case that the image of the predetermined area has an optical density lower than the predetermined value; and conveying means for conveying a recording medium in a sub-scan direction.

36. The apparatus according to claim 35, wherein in said multiscanning mode the recording medium is conveyed by said conveying means after every main scan by a length corresponding to a width equivalent to a plurality of recording elements into which the recording elements of said recording head are divided.

37. The image recording apparatus according to claim 35, wherein in the multi-scanning mode, the plurality of recording elements of the recording head are divided into a plurality of blocks and the plurality of complementary scans are performed in the main scanning, using each of the plurality of blocks by changing blocks in every scan, until every block has performed printing over the same printing area, and wherein neighboring dots printed in a direction of the scan by the plurality of blocks are printed using different printing elements of the recording head.

38. The image recording apparatus according to claim 37, wherein the dots printed in the direction of the scan are interlaced in modulus equal to the number of the plurality of blocks.

39. An image recording apparatus for recording an image using a recording head having a plurality of recording elements, comprising:

image forming means for forming an image of a predetermined area by causing said recording head to perform main scanning in a direction different from a direction in which said recording elements are arrayed, said image forming means being operable in a single scanning mode for forming the image of said predetermined area in a single scan of said recording head, and a multiscanning mode for forming the image of said predetermined area in a plurality of complementary scans of different recording elements of said recording head;

selecting means for selecting said single scanning mode in a case that the image of the predetermined area has an optical density higher than a predetermined value and selecting said multiscanning mode in a case that the image of the predetermined area has an optical density lower than the predetermined value; and reading means for reading an image to be recorded by said recording head.

40. An image recording apparatus for recording an image using a recording head having a plurality of recording elements, comprising:

image forming means for forming an image of a predetermined area by causing said recording head to perform main scanning in a direction different from a direction in which said recording elements are arrayed, said image forming means being operable in a single scanning mode for forming the image of said predetermined area in a single scan of said recording head, and a multiscanning mode for forming the image of said predetermined area in a plurality of complementary scans of different recording elements of said recording head;

selecting means for selecting one of said single scanning mode and said multiscanning mode; and judging means for judging whether or not an image to be recorded has an optical density higher than a predetermined value, wherein said selecting means selects the multiscanning mode in a case that said judging means judges the image to be recorded has an optical density lower than the predetermined value and said detecting means selects the single scanning mode in a case that said judging means judges the image to be recorded has an optical density higher than the predetermined value.

41. The apparatus according to claim 40, further comprising reading means for reading an image to be recorded by said recording head, wherein said judging means judges the optical density of the image read by said reading means.

42. The apparatus according to claim 41, wherein reading speed of said reading means is higher when reading is performed for a judgment rendered by said judging means than when reading is performed for the recording by said recording head.

43. The apparatus according to claim 41, wherein said judging means judges the optical density of the image in a unit equivalent to said predetermined area before said reading means reads the image.

44. The apparatus according to claim 41, wherein said reading means has a low resolution.

45. An image recording apparatus for recording an image using a recording head having a plurality of recording elements, comprising:

image forming means for forming an image of a predetermined area by causing said recording head to perform main scanning in a direction different from a direction in which said recording elements are arrayed, said image forming means being operable in a single scanning mode for forming the image of said predetermined area in a single scan of said recording head, and a multiscanning mode for forming the image of said predetermined area in a plurality of complementary scans of different recording elements of said recording head; and selecting means for selecting one of said single scanning mode and said multiscanning mode based on whether or not the image of the predetermined area has an optical density higher than a predetermined value, wherein said selecting means selects the multiscanning mode when the image of the predetermined area has an optical density lower than the predetermined value and selects the single scanning mode when the image of the predetermined area has an optical density higher than the predetermined value.

46. The apparatus according to claim 45, wherein said recording head discharges ink by thermal energy.

47. An image recording apparatus for recording an image using a recording head having a plurality of recording elements, comprising:

image forming means for forming an image of a predetermined area by causing said recording head to perform main scanning in a direction different from a direction in which said recording elements are arrayed, said image forming means being operable in a single scanning mode for forming the image of said predetermined area in a single scan of said recording head, and a multiscanning mode for forming the image of said predetermined area in a plurality of complementary scans of different recording elements of said recording head; and selecting means for selecting one of said single scanning mode and said multiscanning mode based on whether or not the image of the predetermined area has an optical density higher than a predetermined value, wherein said selecting means selects the multiscanning mode when a command from a host computer indicates that the image of the predetermined area has an optical density lower than the predetermined value and selects the single scanning mode when a command from the host computer indicates that the image of the predetermined area has an optical density higher than the predetermined value.

48. An image recording apparatus for recording an image using a recording head having a plurality of recording elements, comprising:

image forming means for forming an image of a predetermined area by causing said recording head to perform main scanning in a direction different from a direction in which said recording elements are arrayed, said image forming means being operable in a single scanning mode for forming the image of said predetermined area in a single scan of said recording head, and a multiscanning mode for forming the image of said predetermined area in a plurality of complementary scans of different recording elements of said recording head; and selecting means for selecting one of said single scanning mode and said multiscanning mode based on whether or not the image of the predetermined area has an optical density higher than a predetermined value, wherein said selection means selects the multiscanning mode when the image of the predetermined area has an optical density lower than the predetermined value and selects the single scanning mode when the image of the predetermined area has an optical density higher than the predetermined value and said image recording apparatus is utilized in a facsimile apparatus having a communication function.

49. An image recording method for recording an image using a recording head having a plurality of recording elements, comprising the steps of:

selecting a recording mode for forming an image of a predetermined area by causing said recording head to perform main scanning in a direction different from a direction in which said recording elements are arrayed, with the selection based on whether or not the image information has an optical density higher than a predetermined value;

forming the image of said predetermined area by a single scan of said recording head when a single scanning mode is selected in said selecting step; and forming the image of said predetermined area by a plurality of complementary scans of different recording elements of said recording head when a multiscanning mode is selected in said selecting step, wherein in said selecting step, said multiscanning mode is selected when the image information has an optical density lower than the predetermined value and said single scanning mode is selected when the image information has an optical density higher than the predetermined value.

50. The method according to claim 48, further comprising the step of judging optical density of an image to be recorded, wherein said selecting step selects the recording mode in dependence upon the optical density judged in said judging step.

51. The method according to claim 50, further comprising a step of reading an image to be recorded by said recording head, wherein said judging step judges the optical density of the image read in said reading step.

52. The method according to claim 49, wherein said recording head discharges ink.

53. The method according to claim 52, wherein said recording head discharges ink by thermal energy.

54. The method according to claim 49, wherein said selecting step selects one of said modes in response to a command from a host computer.

55. An image recording method for recording an image using a recording head having a plurality of recording elements, said method comprising the steps of:

selecting a recording mode for forming an image of a predetermined area by causing said recording head to perform main scanning in a direction different from a direction in which said recording elements are arrayed, with the selection based on whether or not image information has an optical density higher than a predetermined value;

forming the image of said predetermined area by a single scan of said recording head when a single scanning mode is selected in said selecting step; and forming the image of said predetermined area by a plurality of complementary scans of different recording elements of said recording head when a multiscanning mode is selected in said selecting step, wherein said image recording method is applied to a recording method in a facsimile apparatus having a communication function, wherein in said selecting step, said multiscanning mode is selected when the image information has an optical density lower than the predetermined value and said single scanning mode is selected when the image information has an optical density higher than the predetermined value.

56. An image printing apparatus for causing a printing head having a plurality of printing elements to perform main scanning in a direction different from a direction in which the printing elements are arrayed and printing an image on a printing medium based upon entered image information, comprising:

first printing means for printing, by a single scan of said printing head, an image having a printing width corresponding to the width of the plurality of printing elements related to the printing by said first printing means;

second printing means for dividing the plurality of printing elements on the printing head into a plurality of blocks, and for printing in the main scanning, using each of the plurality of blocks by changing blocks in every main scanning, until every block has performed printing over the same printing area, and wherein dots neighboring in a direction of the main scanning are printed using different printing elements of the printing head;

selecting means for selecting one of said first and second printing means, with the selection based on whether or not the image information has an optical density higher than a predetermined value; and conveying means for conveying the printing medium by a length corresponding to the width of each block every scanning in a sub-scan direction substantially perpendicular to the direction of the main scanning, wherein said selecting means selects said second printing means when the image information has an optical density lower than the predetermined value and selects said first printing means when the image information has an optical density higher than the predetermined value.

57. The printing apparatus according to claim 56, wherein the dots printed in the direction of the main scanning are interlaced in modulus equal to the number of the plurality of blocks.

58. An image recording apparatus for recording an image on a recording medium using a recording portion having a plurality of recording elements, comprising:

image forming means for forming an image of a predetermined area by controlling said recording portion to perform main scanning in a direction different from a direction in which said recording elements are arrayed, said image forming means having a single scanning mode for forming the image of said predetermined area by a single scan of said recording portion, and a multi-scanning mode for forming the image of said predetermined area by a plurality of complementary scans of different recording elements of said recording portion;

selecting means for selecting one of said single scanning mode and said multi-scanning mode based on whether or not the image information has an optical density higher than a predetermined value; and conveying means for conveying the recording medium by a length corresponding to the predetermined area every complementary scan in a sub-scan direction substantially perpendicular to the direction of the main scanning, wherein said selecting means selects said multi-scanning mode when the image information has an optical density lower than the predetermined value and selects said single scanning mode when the image information has an optical density higher than the predetermined value.

59. The image recording apparatus according to claim 58, wherein in said multi-scanning mode, the plurality of recording elements on the recording portion are divided into a plurality of blocks, and recording is performed in the main scanning, using each of the plurality of blocks by changing blocks in every main scanning, until every block has performed printing over the predetermined area, and wherein dots neighboring in a direction of the main scanning are printed using different recording elements of the recording head.

60. The image recording apparatus according to claim 59, wherein the dots recorded in the direction of the main scanning are interlaced in modulus equal to the number of the plurality of blocks.

61. An image recording apparatus for recording an image using a recording head having a plurality of recording elements, comprising:

image forming means for forming an image of a predetermined area by causing the recording head to perform main scanning in a direction different from a direction in which the recording elements are arrayed, said image forming means being operable in a single scanning mode for forming the image of the predetermined area in a single scan of the recording head, and a multiscanning mode for forming the image of the predetermined area in a plurality of scans of different recording elements of the recording head; and selecting means for selecting one of the single scanning mode and the multiscanning mode based on information regarding whether or not the image of the predetermined area comprises character information, wherein said selecting means selects the multiscanning mode in a case the image does not comprise the character information and said selecting means selects the single scanning mode in a case that the image comprises the character information.

62. An image recording method for recording an image using a recording head having a plurality of recording elements, comprising the steps of:

forming an image of a predetermined area by causing the recording head to perform main scanning in a direction different from a direction in which the recording elements are arrayed, said image forming step being operable in a single scanning mode for forming the image of the predetermined area in a single scan of the recording head, and a multiscanning mode for forming the image of the predetermined area in a plurality of scans of different recording elements of the recording head; and selecting one of the single scanning mode and the multiscanning mode based on information regarding whether or not the image of the predetermined area comprises character information, wherein in said selecting step, the multiscanning mode is selected in a case the image does not comprise the character information and the single scanning mode is selected in a case that the image comprises the character information.

* * * * *

UNITED STATES PATENT AND TRADEMARK OFFICE

CERTIFICATE OF CORRECTION

PATENT NO. : 6,318,830 B1
DATED : November 20, 2001
INVENTOR(S) : Sugishima

It is certified that error appears in the above-identified patent and that said Letters Patent is hereby corrected as shown below:

Title page,
Item [56], References Cited, FOREIGN PATENT DOCUMENTS, "2088264" should read -- 2-088264 --.

Column 4,
Line 56, "drive'" should read -- drive --.

Column 13,
Line 11, "ovary" should read -- every --.
Line 56, "claim 9," should read -- claim 19, --.

Column 19,
Line 9, "claim 48," should read -- claim 49, --.

Signed and Sealed this

Thirteenth Day of August, 2002

*Attest:*

*Attesting Officer*

JAMES E. ROGAN
*Director of the United States Patent and Trademark Office*